United States Patent [19]

Lu

[11] Patent Number: 4,822,195

[45] Date of Patent: Apr. 18, 1989

[54] MULTI-PURPOSE ALBUM

[76] Inventor: Tsann T. Lu, No. 49, Hsin Le Road, An Ping Industrial Distrial, Tainan, Taiwan

[21] Appl. No.: 58,948

[22] Filed: Jun. 4, 1987

[51] Int. Cl.[4] ..... BA42 3/02; BA42 13/00; A47G 1/06; G09F 1/12

[52] U.S. Cl. ..... 402/53; 402/80 R; 40/155; 40/156

[58] Field of Search ..... 402/48, 49, 53, 73, 402/74, 79, 80 R, 80 P; 281/29; 40/152, 152.1, 155, 156, 157, 158 R, 159

[56] References Cited

U.S. PATENT DOCUMENTS

| | | | |
|---|---|---|---|
| 1,175,404 | 3/1916 | Blattel | 402/53 |
| 1,911,358 | 5/1933 | Gaertig | 402/53 |
| 3,751,839 | 8/1973 | Mitchell | 40/158 R |
| 3,974,576 | 8/1976 | Quinn | 40/156 |
| 4,187,630 | 2/1980 | Giulie et al. | 40/156 |
| 4,229,892 | 10/1980 | Hueter et al. | 40/155 |
| 4,479,733 | 10/1984 | Segal | 402/80 R |
| 4,594,802 | 6/1986 | Field | 40/152.1 |

FOREIGN PATENT DOCUMENTS

| | | | |
|---|---|---|---|
| 1436175 | 3/1969 | Fed. Rep. of Germany | 281/29 |

*Primary Examiner*—E. R. Kazenske
*Assistant Examiner*—Paul M. Heyrana, Sr.
*Attorney, Agent, or Firm*—Lowe, Price, Leblanc, Becker & Shur

[57] ABSTRACT

This invention relates to a multi-purpose album and in particular to one including a front cover, a back cover, a number of pages and a supporting stand. The front cover and the back cover are constituted by a flap and a slide plate, which flap has a rectangular recess at the central position for receiving a transparent plastic sheet and three raised edges. The slide plate may be inserted into the front cover and has a hinged portion which may overlap thereon. The hinged portion has two holes and two self-attaching pads. The pages are provided with two holes for receiving two sets of screws and nuts designed to bind the pages, the front cover and the back cover together.

3 Claims, 4 Drawing Sheets

MULTI-PURPOSE ALBUM

BACKGROUND OF THE INVENTION

It is found that the typical photo album on the market has as its only purpose the collecting of photographs. Furthermore, the pages thereof are permanently bound together and so the number thereof cannot be adjusted to adapt to the quantity of photographs.

It is, therefore, an object of the present invention to provide an album which may obviate and mitigate the above-mentioned drawbacks.

SUMMARY OF THE INVENTION

This invention relates to a multi-purpose album.

It is the primary object of the present invention to provide an album the capacity of which can be adjusted.

It is another object of the present invention to provide an album the front and rear covers of which can receive the user's favorite photographs.

It is still another object of the present invention to provide an album which can be used as a picture frame.

It is still another object of the present invention to provide an album which can be used as an ornamentation.

It is a further object of the present invention to provide an album which is simple in construction.

DETAILED DESCRIPTION OF THE PREFERRED EMBODIMENT

Figure 1:
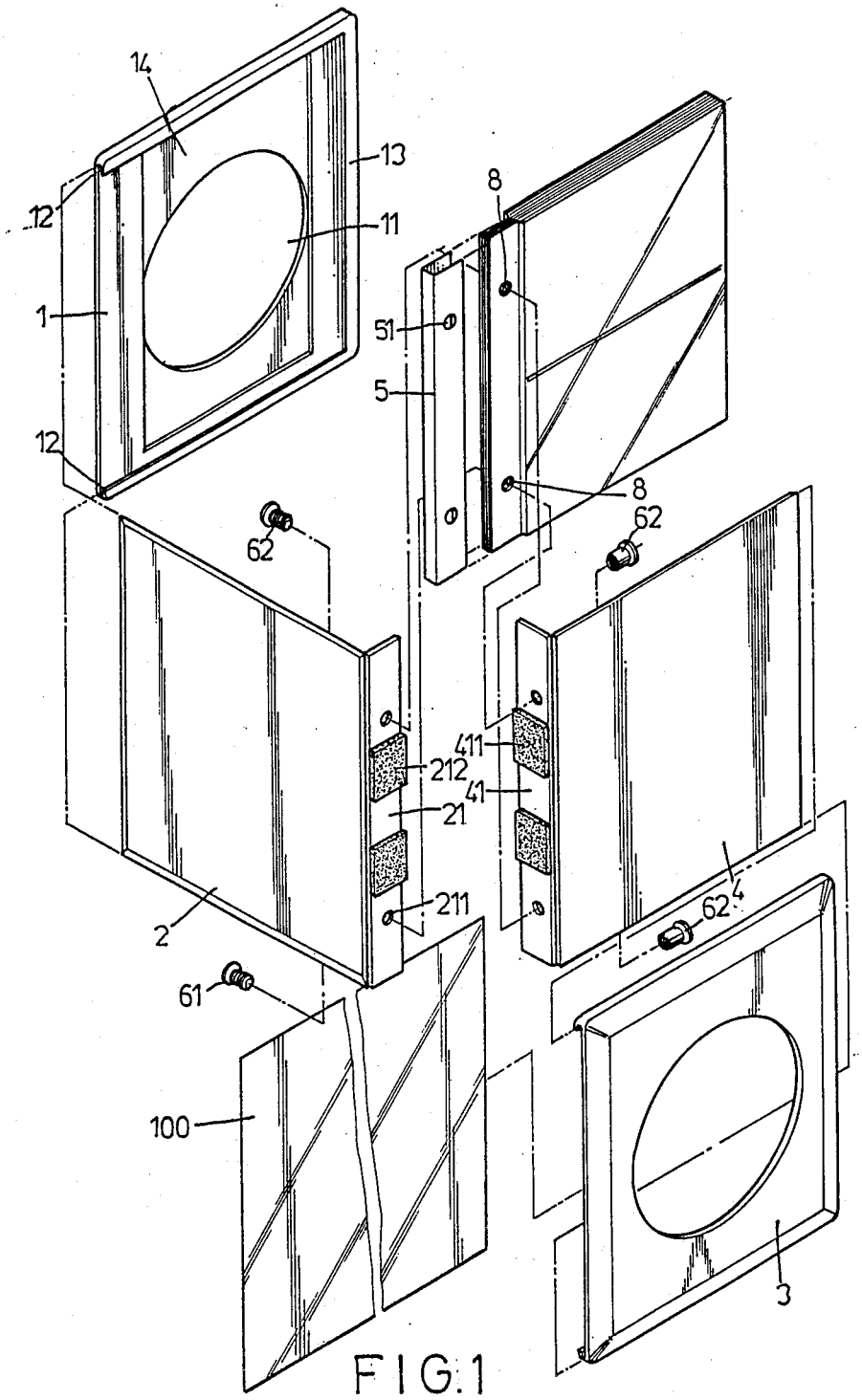
FIG. 1 is an exploded view of the present invention.

Turning to the drawings and referring first to FIG. 1, the present invention comprises a front cover, a back cover and a plurality of pages. The front cover consists of a front flap 1 and a slide plate 2. The front flap 1 has a center hole 11 shaped into an ellipse, a rectangular recess 14 formed at the central portion of the inner side thereof, and three raised edges 13. The upper and lower edges 13 are each provided with a slot 12 so that a transparent plastic sheet 100 and a desired photograph (not shown) can be inserted therein. Then, the slide plate 2 is inserted into the front flap 1 along the slots 12 to keep the photograph in the central position of the front flap 1. The slide plate 2 is provided with a hinged portion 21 which may overlap the slide plate 2 in some positions. The hinged portion 21 further has two holes 211 and two self-attaching pads 212.

The back cover includes a back flap 3 and a slide plate 4 which are respectively similar to the front flap 1 and the slide plate 2 in structure.

Each page is formed with two holes 8 adapting to the holes 211 of the swing 21.

In assembly, a desired number of pages are arranged so that the holes 8 are in alignment with one another, thereby enabling the pages to be bound together.

Figure 2:
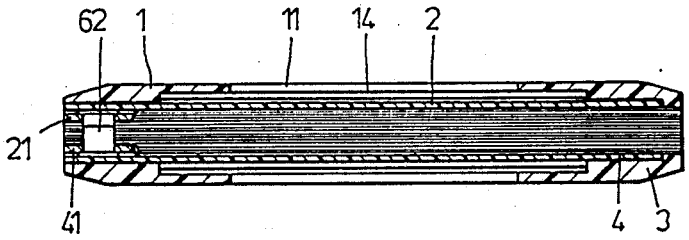
FIG. 2 is a cross-sectioned view of the present invention.
Figure 3:
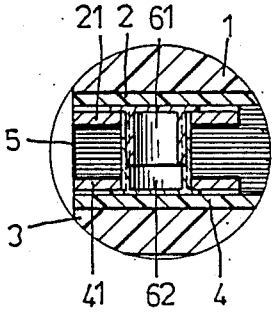
FIG. 3 is an enlarged fragmentary view of FIG. 2.

With reference to FIG. 2, a desired number of pages are first arranged so that the holes 8 thereof are aligned with one another. Then, a U-shaped protecting frame 5 provided thereon with holes 51 (disposed to match holes 8) is mounted on the edge formed with holes 8. Two screws 61 are sequentially inserted into the holes 211 of the swing 21, the holes 51 of the U-shaped protecting frame 5 and the holes 8 of the pages. Thereafter, two nuts 62 are engaged respectively with the screws 61 to form a whole album. The screws 61 and the nuts 62 can be adjusted to adapt to the number of pages.

Figure 4:
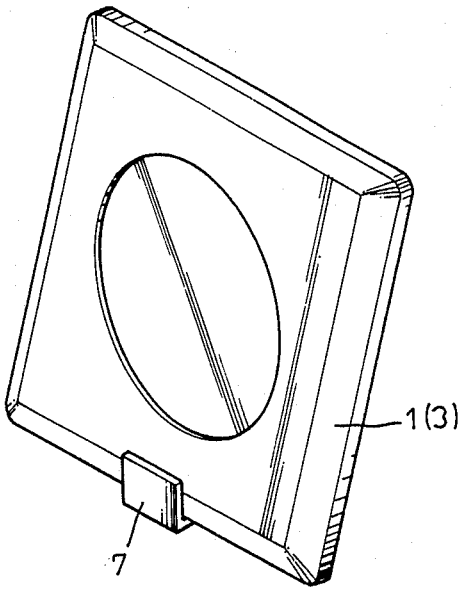
FIG. 4 shows an application of the present invention.
Figure 5:
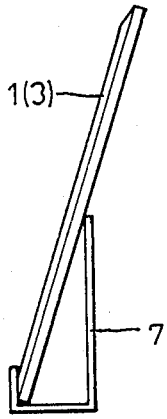
FIG. 5 is side elevationed view of FIG. 4.
Figure 6:
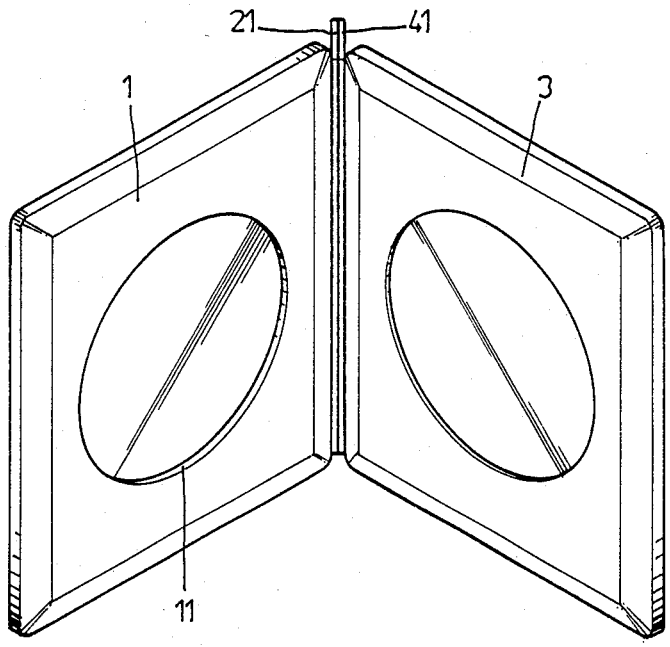
FIG. 6 shows a second application of the present invention.

When it is desired to dismantle the front cover and the back cover to form a picture frame, a user must first release the screws 61 from the nuts 62 and remove the front cover and the back cover. Then, the screws 61 are engaged with the nuts 62 to fixedly bind the pages together. Hence, the front cover and the back cover can be supported by a supporting frame 7 (see FIG. 4). By means of the self-attaching pads 212 and 412, both the front cover and the back cover can together be formed into a whole body by folding over the respective hinged portion of each (see FIG. 6). Thus, the dismantled front cover and the back cover can be used with each other without the pages to serve independently or separately as a picture frame or for ornamentation.

From the above, it is understood that the present invention can be easily adjusted in the number of pages by means of using the engagement of screws and nuts. Further, the front cover and the back cover thereof can receive a subject photograph which may serve to explain the contents of the collected inside the album photographs. Moreover, the front cover and the back cover of the present invention can be dismantled to form a picture frame separately from the pages. It is apparent that various modifications can be made within the scope and spirit of the invention as hereinafter claimed.

I claim:

1. A multi-purpose album comprising:

a front cover;

a back cover; and a plurality of pages, characterized in that said front cover and said back cover each includes a flap and a slide plate, said flap having three raised edges and a rectangular recess at a central portion for receiving a transparent plastic sheet, said slide plate being insertable into said flap and having a hinged portion which may overlap thereon, said hinged portion having two holes and two self-attaching pads, said pages each having two correspondingly disposed holes for receiving two sets of screws and nuts for binding the pages, the front cover and the back cover together.

2. A multi-purpose album as claimed in claim 1, further comprising:

supporting stand means for supporting said album at said front cover or back cover to enable said album to form a picture frame.

3. A multi-purpose album as claimed in claim 1, wherein:

said hinged portions have said self-attaching pads so that the front cover and back cover may be joined together with their respective hinged portions directly to each other with all pages removed from between them to form a picture frame.

* * * * *